US006059392A

United States Patent [19]

Park

[11] Patent Number: 6,059,392

[45] Date of Patent: May 9, 2000

[54] APPARATUS FOR ADJUSTING HEAD GAP DEPENDING UPON THE THICKNESS OF PRINTING PAPER IN INK JET PRINTER

[75] Inventor: Gyeong-Ho Park, Kyungki-do, Rep. of Korea

[73] Assignee: SamSung Electronics Co., Ltd., Kyungki-do, Rep. of Korea

[21] Appl. No.: 08/984,888

[22] Filed: Dec. 4, 1997

[30] Foreign Application Priority Data

Dec. 4, 1996 [KR] Rep. of Korea ..... 96-45576

[51] Int. Cl.[7] ..... B41J 25/308

[52] U.S. Cl. ..... 347/8; 400/56

[58] Field of Search ..... 347/8, 20, 37; 400/55–56, 59–60

[56] References Cited

U.S. PATENT DOCUMENTS 5,468,076 11/1995 Hirano et al. ..... 347/8

*Primary Examiner*—John Barlow
*Assistant Examiner*—Juanita Stephens
*Attorney, Agent, or Firm*—Robert E. Bushnell, Esq.

[57] ABSTRACT

An apparatus for adjusting head gap depending upon the thickness of printing paper in an ink jet printer. The apparatus may be constructed with a unit for moving a printer head into a vertical direction of the printing paper so as to adjust the head gap corresponding to a distance between a nozzle of the printer head and the printing paper.

19 Claims, 4 Drawing Sheets

APPARATUS FOR ADJUSTING HEAD GAP DEPENDING UPON THE THICKNESS OF PRINTING PAPER IN INK JET PRINTER

CLAIM OF PRIORITY

This application makes reference to, incorporates the same herein, and claims all benefits accruing under 35 U.S.C. §119 from an application entitled *Apparatus for Adjusting Head Gap Depending upon the Thickness of Printing Paper in Ink Jet Printer* earlier filed in the Korean Industrial Property Office on Dec. 4, 1996, and there duly assigned Ser. No. 96-45576 by that Office.

BACKGROUND OF THE INVENTION

1. Field of the Invention

The present invention relates to image formation processes and apparatus generally, and, more particularly, to an apparatus and process for adjusting a head gap in ink jet printers in dependence upon the thickness of printing paper in the ink jet printer.

2. Discussion of Related Art

In general, ink jet printers have a printer head that is mounted in a carriage. Cut sheets of paper to be printed with symbols by the printer head are drawn from a cassette seriatim and transferred under the influence of a pick-up roller to a position under the nozzle of the printer head. Conventional printers form images upon a medium such as a cut sheet of paper by propelling jets of ink from the nozzle in the bottom of the printer head and onto the paper positioned under the printer head. Typically, there a gap occurs between the printer head and the paper to be printed by the printer. I have found that when the paper is thicker than the general run of office paper stock (e.g., twenty pound xerographic paper), the paper all too frequency exhibits poor printing characteristics such as spread, stain with ink and inclination of the nozzle of the printer head, and resolution of the images being printed deviate due to variations between the gap between the paper being printed and the printer head. Conventional designs of printers such as those discussed in conjunction with FIGS. 1 and 2 below, either fail to provide for adjustment of this gap, or do not provide a convenient mechanism with which to readily and accurately adjust the gap.

In conventional and contemporary designs for ink jet printers, even if it is possible to adjust the head gap between the nozzle of the printer head and the printing paper so as to increase the gap along the front part of the carriage, because the nozzle is mounted with a inclination relative to the paper, if the number of holes in the nozzle is increased in order to increase the speed of printing, the nozzle becomes long. In recent designs, the length of the nozzle is about ten millimeters and differences in the height of the nozzle do occur. I have therefore, found that there is a problem in contemporary designs for ink jet printers, because of the occurrence of a deviations between the start point and the end point of the printing operation attributable to the feed roller. Efforts have been made in the art to adjust the head gap by rotating the carriage on the basis of deviations of the print operation. I have also found that these efforts cause additionally problems because the efficiency of the printing operation can be reduced by concomitant deviations in the resolution deviation when the print operation is performed on thicker printing stock such as on either an envelope or on a postcard.

SUMMARY OF THE INVENTION

It is therefore, an object of the present invention to provide an improved process and apparatus for forming images upon printable media.

It is another object to provide a head gap adjusting process and apparatus capable of enhancing print resolution on stocks of printable media of varying properties by adjusting the distance between a printer head and printing paper, and of improving the quality of the printing.

It is still another object to provide a head gap adjusting process and apparatus for preventing deviations in resolution of printed images when the print operation is performed while the nozzle is inclined against the paper being printed according to the adjustment of the head gap.

These and other object may be achieved in accordance with the principles of the present invention, as embodied and broadly described, by using a process and apparatus for adjusting the head gap in the ink jet printer constructed with a unit for moving a head of a printer in a vertical direction from the paper being printed so as to adjust the head gap direction of the printing paper in correspondence with the distance between the nozzle of the printer head and the printing paper.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
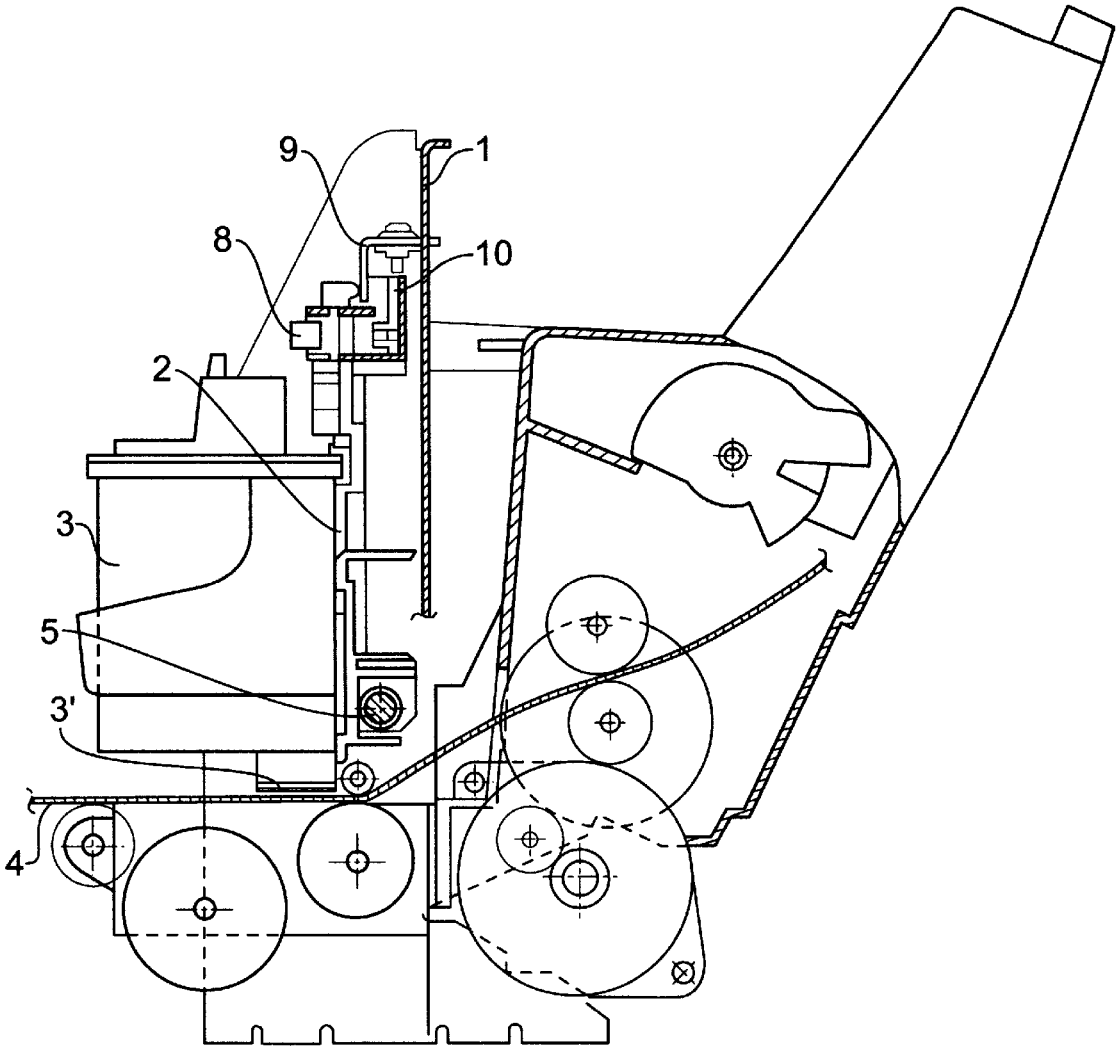
FIG. 1 illustrates a printing part of an ink jet printer.

FIG. 1 illustrates a printing part of the ink jet printer according to the prior art. In FIG. 1, the ink jet printer is intended to fix a carriage 2 in a chassis 1 by means of a guide rail 9 and a carriage shaft 5. And, a knob 8 and a slider 10 are mounted to move the ink jet printer head in the right and left direction.

In the ink jet printer structured in the above manner, the printing paper through the pick-up roller 60 is transferred to the bottom of the printer head 3 form a feed roller 70. Therefore, if the printing paper 4 is transferred to the bottom of the printer head 3, a letter or a drawing is printed on the printing paper by the ink jetted form the nozzle 31 of the printer head 3.

However, in the ink jet printer of the prior art, there may arise a problem that there is provided no device to adjust the gap mentioned in the above, even though the gap is made between the printer head and the printing paper. Thus, if a print operation is performed in the paper being twice or three times as thick as the general paper, the gap therebetween is not constant. Thereby, the spread or stain with the ink is made on the printing paper and the printing resolution is poor accordingly.

Figure 2:
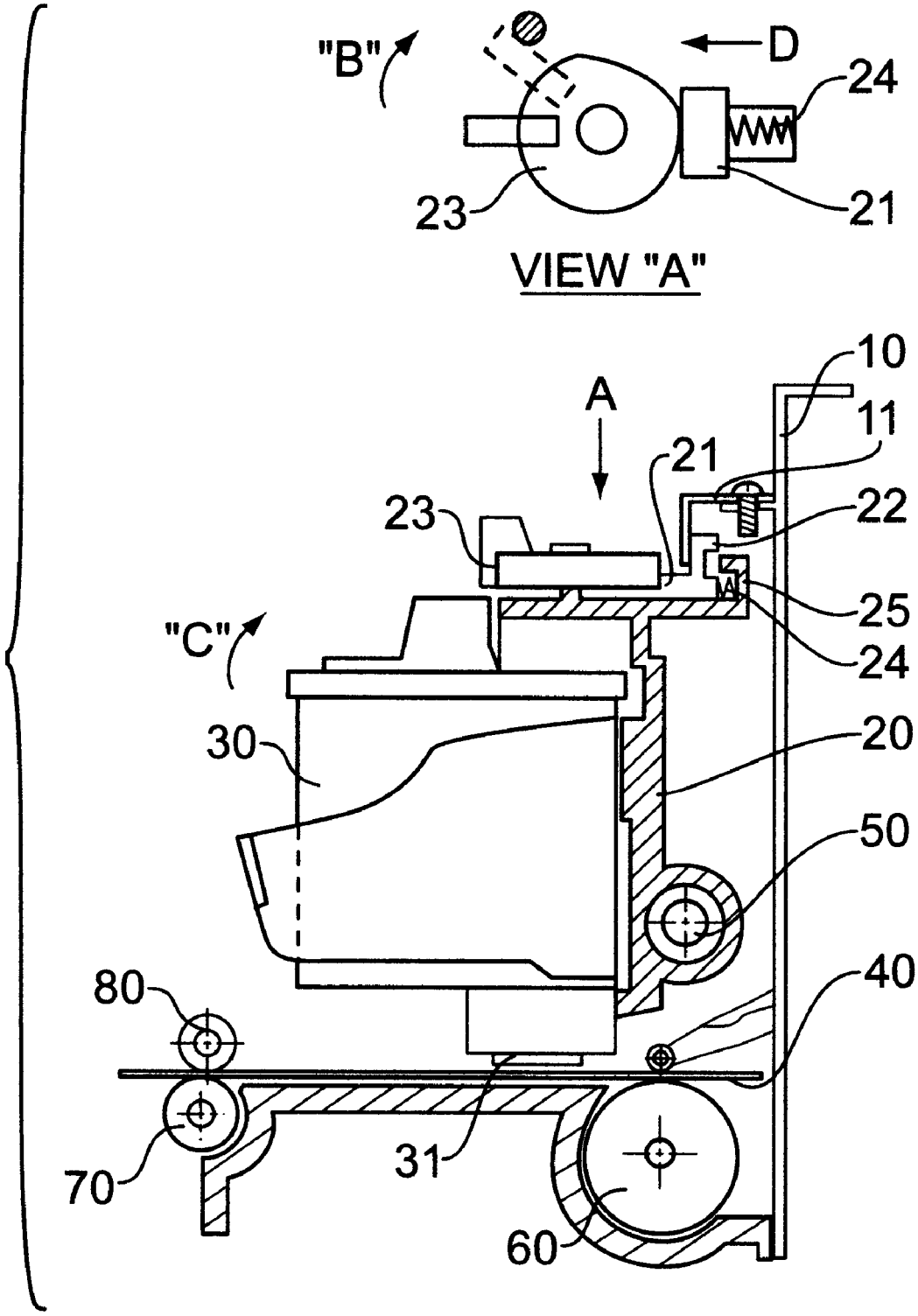
FIG. 2 illustrates a head gap adjusting apparatus of an ink jet printer.
Figure 3:
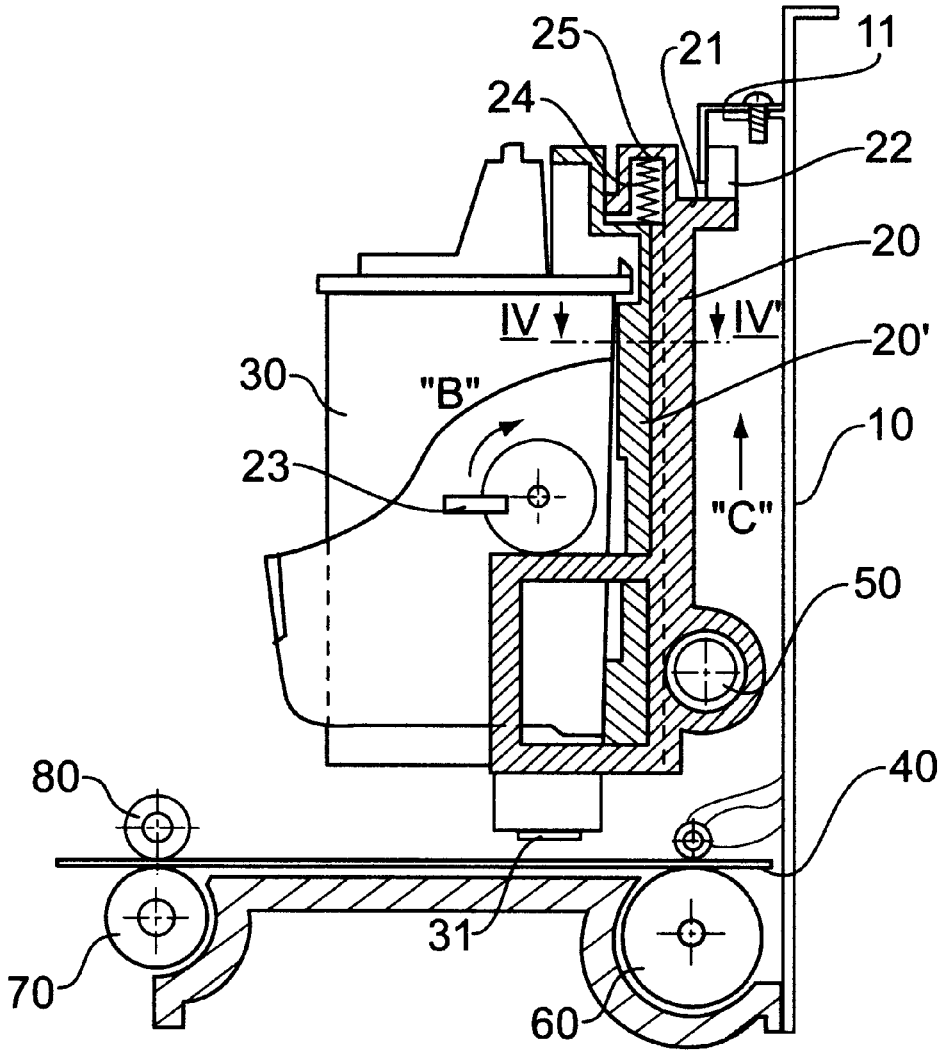
FIG. 3 illustrates a head gap adjusting apparatus of the ink jet printer constructed according to the principles of the present invention.
Figure 4:
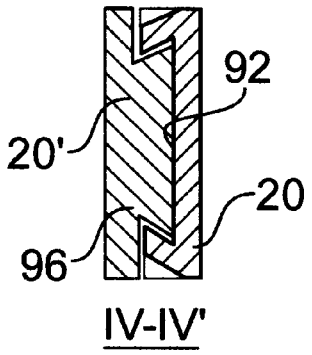
FIG. 4 is a cross-sectional diagram along sectional line IV-IV' of FIG. 3.

FIG. 2 illustrates a head gap adjusting apparatus of the ink jet printer according to the prior art. Carriage 20 is fixed in the chassis 10 by means of the guide rail 11 and the carriage shaft 50. A guide slider 22 is formed in the one-body with the carriage guide 21 to thereby move the carriage 20 in the right and left direction through a contact with the guide rail 11.

In FIG. 2, in order to adjust the gap of the printer head 30, a compressing spring 24 is mounted between the carriage guide 21 and the spring guide 25. Further, so as to move the carriage guide 21 to the forward and backward direction, a cap-shaped cam lever 23 is fixed in the top part of the carriage 20 and contacted with the carriage guide 21. Thus, in the ink jet printer represented by FIG. 2, if the cam lever 23 is rotated in the B direction, the carriage guide 21 is pushed according to the curve of the cam lever 23. And, since the spring guide 25 is fixed in the carriage 20, the carriage guide 21 is moved to the D direction by means of a repelling power of the compressing spring 24. Thereby, the carriage 20 in which the printer head is mounted is turned on an axis of the carriage shaft 50 in the C direction by means of the movement of the carriage guide 21. Therefore, the carriage 20 is raised in only its front part on the axis of the carriage shaft 50.

Reference will now be made in detail to the preferred embodiments of the present invention, examples of which are illustrated in the accompanying drawings. FIGS. 3, 4, 5, and 6 illustrate a head gap adjusting apparatus of the ink jet printer constructed in accordance with the principles of the present invention. The ink jet printer is fixed by a guide rail 11 so as to transfer a carriage 20 onto the top part of a chassis 10. In the structure of the head gap adjusting apparatus of the ink jet printer, a sub carriage 20' is inserted into a sliding hole (not shown) formed in the front part of the carriage 20 so as to move a sub carriage rail 96 formed on the sub carriage 20' along a groove 92 formed on carriage 20 so that the sub carriage 20' can be installed in the carriage 20. A cam lever 23 is fixed in the slide part of the sub carriage 20' so as to adjust the head gap. A guide slider 22 is arranged to be a one-body with the carriage 20 so as to move the carriage 20 during the print operation. In order to adjust the head gap, a compressing spring 24 is mounted between the spring guide 25 and the sub carriage 20'.

Thus, when the printing paper sent by the feed roller 60 is transferred to the bottom of the nozzle of the printer head 30, the ink is jetted from the nozzle 31, thereby ejecting the printing paper 40 through an ejecting roller 70 and a star wheel 80. The head gap adjusting apparatus of the ink jet printer is employed to rotate the cam lever 23 in the C direction when the print operation is performed in the thicker paper than the general paper, the cam lever 23 being disposed in the side part of the sub carriage 20'.

Figure 5:
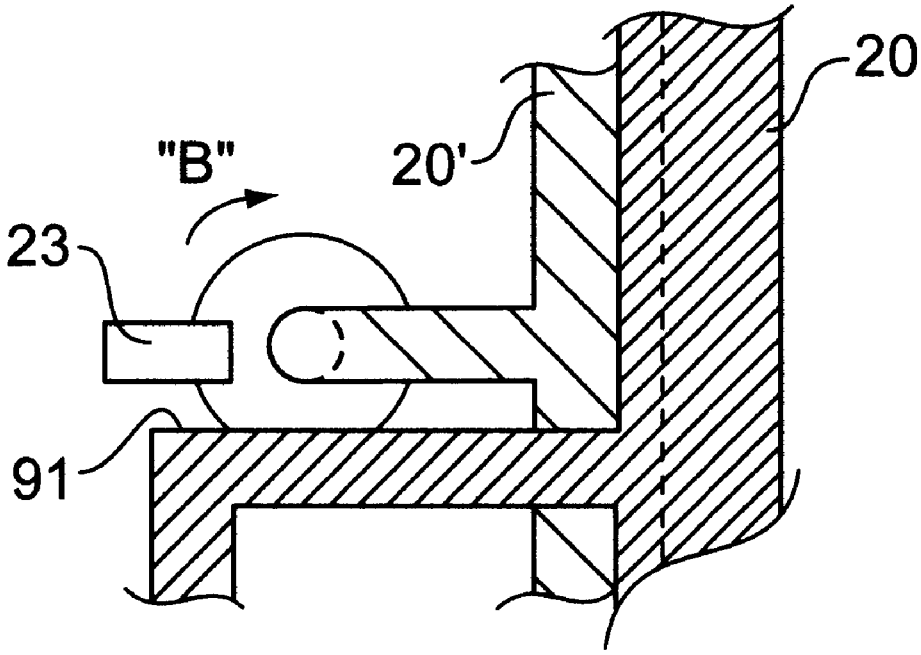
FIG. 5 is a partial cross-sectional view showing a sub carriage and a carriage of FIG. 3.
Figure 6:
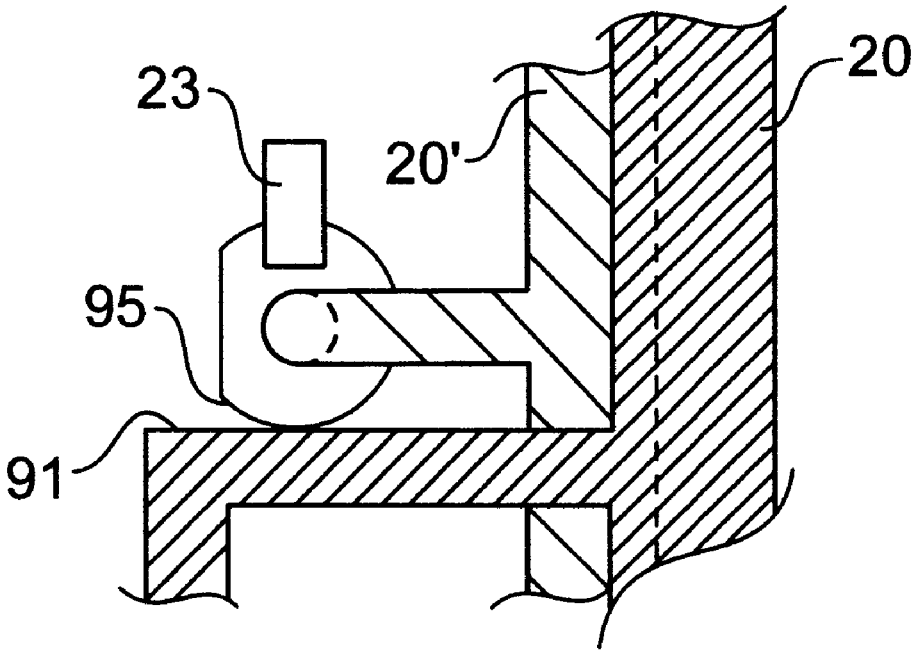
FIG. 6 is a partial cross-sectional view showing the rise of the sub carriage from the carriage according to the preferred embodiment of the present invention.

On the other hand, since the cam lever 23 is formed in a cam shape, as shown in FIG. 5, the carriage 20 is fixed on axis of the carriage shaft 50 and the sub carriage 20' is contacted with the printer head 30. Thus, if the cam lever 23 is rotated in the B direction, the circumference 95 of the cam lever 23 is contacted with the side part 91 of the carriage 20 as shown in FIG. 6. In this case, when the cam lever 23 is rotated by about 90 degree, the radius of the cam lever 23 becomes long, thereby pushing the sub carriage to the top direction thereof. The compressing spring 24 is pressed by the rise of the sub carriage 20' accordingly. That is, the spring guide 25 is formed in a one-body with the carriage 20 on the axis of the carriage shaft 50 to thereby support the compressing spring 24. Further, since the sub carriage 20' presses the compressing spring 24, it is moved to the C direction and the printer head mounted in the sub carriage 20' is also moved to the C direction, so that the nozzle is moved to the C direction.

In the above, when the print operation is performed in the envelope or the postcard thicker than the general paper, if the cam lever 23 is turned in 90 degree, the nozzle is also moved to the C direction. Thereby, the head gap is adjusted and made constantly.

Accordingly, in the head gap adjusting apparatus of an ink jet printer constructed according to the principles of the present invention, the cam lever properly moves the carriage when the thick paper like the envelope or postcard is used therein, thereby constantly keeping the head gap, regardless of the thickness of the printing paper, and thereby obtaining the same resolution as that of the general paper. Thus, there is provided in the present invention an efficiency to improve the printing state such as spread and stain with ink. Furthermore, embodiments of the present invention provides another efficiency to present the resolution deviation and to enhance the print operation by preventing the nozzle from being inclined against the printing paper.

The foregoing paragraphs describe the details of image formation processes and apparatus in which the head gap of ink jet printers may be adjusted in dependence upon the thickness of paper being printed by the ink jet printer. This advantageously improves upon such poor printing characteristics like spread, stain with ink and inclination of a nozzle of the printer head that attended prior ink jet image formation due to the paper being thicker than the general run of cut sheets of paper, and prevents substantial deviation in the resolution by keeping a constant gap between the paper being printing and the printer head through a simple operation by means of a lever. It should therefor, be readily apparent to those skilled in the art that various modifications and variations can be made in the head gap adjusting apparatus of the ink jet printer of the present invention without departing from the spirit or scope or scope of the invention. Thus, it is intended that the present invention cover the modification and variations of this invention provided they come within the scope of the appended claims and their equivalents.

What is claimed is:

1. An apparatus for adjusting head gap depending upon the thickness of printing paper in an ink jet printer, comprising:

a carriage accommodating a printer head, moving said printer head for printing said printing paper; and a unit connected to said carriage, moving a printer head into a vertical direction of said printing paper without moving said carriage so as to adjust said head gap corresponding to a distance between a nozzle of said printer head and said printing paper.

2. The apparatus for adjusting head gap as claimed in claim 1, further comprised of a spring guide mounted on said carriage containing a compressing spring between said carriage and said unit, maintaining said head gap during printing.

3. The apparatus for adjusting head gap as claimed in claim 1, further comprised of a sub carriage rail formed on said unit and inserted into a groove formed on said carriage so as to move said unit along said carriage.

4. The apparatus for adjusting head gap as claimed in claim 1, further comprised of a cam lever connected to said unit and contacting said carriage so as to move said unit in accordance with the rotation of said cam lever.

5. An apparatus in a printer, comprising:

a carriage movably connected to a chassis of said printer, accommodating a printer head, moving along a carriage shaft of said printer during printing a printing medium; and a unit connected to said carriage and said printer head, moving said printer head to said printing medium without moving said carriage to said printing medium so as to adjust a gap between a nozzle of said printer head and said printing medium.

6. The apparatus of claim 1, further comprised of a spring located between said unit and said carriage, maintaining said gap during printing.

7. The apparatus of claim 1, further comprised of said unit located between said carriage and said printer head, containing said printer head, slidably connected to said carriage.

8. The apparatus of claim 1, further comprised of a sub carriage rail formed on said unit and inserted into a groove formed on said carriage so as to slide said carriage.

9. The apparatus of claim 1, further comprised of a cam formed on said unit, contacting a surface of said carriage, moving said unit.

10. An apparatus in a printer, comprising:

a carriage accommodating a printer head;

a carriage shaft connected to said printer and said carriage, moving said carriage so as to print a printing medium; and a sub carriage connected to said carriage and said printer head, moving said printer head to said printing medium so as to adjust a gap between a nozzle of said printer head and said printing medium without moving said carriage.

11. The apparatus of claim 10, further comprised of a sprint connected to said carriage, maintaining said gap during printing.

12. The apparatus of claim 10, further comprised of a spring guide fixed to said carriage, accommodating said spring.

13. The apparatus of claim 10, further comprised of a sub carriage rail connected to said sub carriage, inserted into a groove formed on said carriage so as to move said sub carriage along a surface of said carriage.

14. The apparatus of claim 10, further comprised of a cam rotatably connected to said sub carriage, contacting said carriage.

15. The apparatus of claim 14, further comprised of said cam having a plurality of radii.

16. The apparatus of claim 15, further comprised of a difference between said radii representing an amount of said gab adjusting by said cam.

17. The apparatus of claim 16, further comprised of said cam moving said sub carriage along a surface of said carriage by said difference.

18. The apparatus of claim 10, further comprised of said carriage connected to said carriage shaft, being maintained a constant distance between said printing medium and said carriage regardless adjusting said gap.

19. The apparatus of claim 10, further comprised of a distance between said printing medium and said carriage being maintained constant while said gap varies.

* * * * *